US006548944B1

(12) United States Patent
Morita

(10) Patent No.: US 6,548,944 B1
(45) Date of Patent: Apr. 15, 2003

(54) SPARK PLUG HAVING INSULATING OIL

(75) Inventor: Yoshiki Morita, Kariya (JP)

(73) Assignee: Denso Corporation, Kariya (JP)

( * ) Notice: Subject to any disclaimer, the term of this patent is extended or adjusted under 35 U.S.C. 154(b) by 183 days.

(21) Appl. No.: 09/691,043

(22) Filed: Oct. 19, 2000

(30) Foreign Application Priority Data

Nov. 5, 1999 (JP) ..... 11-315554

(51) Int. Cl.[7] ..... H01T 13/00
(52) U.S. Cl. ..... 313/118; 313/141; 313/143
(58) Field of Search ..... 313/118, 120, 313/132, 137, 143, 141, 142

(56) References Cited

U.S. PATENT DOCUMENTS 4,427,914 A * 1/1984 Mizuno et al. ..... 313/130
4,870,319 A * 9/1989 Benedikt et al. ..... 313/137
4,937,484 A 6/1990 Ishino ..... 313/143
5,128,583 A 7/1992 Ma ..... 313/137
5,274,298 A * 12/1993 Cassidy et al. ..... 313/143

FOREIGN PATENT DOCUMENTS

EP 0933847 A1 4/1999
JP 60-160490 10/1985

* cited by examiner

*Primary Examiner*—Robert H. Kim
*Assistant Examiner*—Jurie Yun
(74) *Attorney, Agent, or Firm*—Nixon & Vanderhye P.C.

(57) ABSTRACT

In a spark plug, an annular seal packing is arranged in a gap defined between an insulator and a fitting. Electrically insulating oil is filled in an oil-retaining section of the gap that is located on the distal side of the packing. The oil-retaining section of the gap is the continuous section having a width ranging from 0.05 mm to 0.3 mm and an axial length of 2 mm or more from the packing. The filled insulating oil is retained within the oil-retaining section of the gap by its surface tension while it is in a liquid state.

9 Claims, 2 Drawing Sheets

SPARK PLUG HAVING INSULATING OIL

BACKGROUND OF THE INVENTION

The present invention relates to a spark plug having electrically insulating oil between an insulator and a fitting for improving anti-fouling performance of the spark plug.

As is well known in the art, the spark plug includes a central electrode sheathed within a cylindrical insulator that is in turn held inside a cylindrical fitting while a distal end of the central electrode disposed adjacent to a distal end of the insulator faces a ground electrode secured to the fitting across a discharging gap. Electrical discharge and ignition take place at the discharging gap, i.e., on the distal end side of the insulator.

In such a spark plug, if a temperature of the igniting section is relatively low (for example, 50 degrees Celsius or below), conductive materials, such as carbons or the like, may adhere to the distal end side of the insulator, so that the insulation resistance is reduced, leading to reduced ignition performance of the spark plug. Particularly, this phenomenon tends to occur before a brand-new automobile is passed to an automobile user from an automobile manufacture or while the mileage of the automobile is below 1000 kilometers.

One proposal to inhibit such fouling is disclosed in Unexamined Japanese Utility Model Publication No. 60-160490. Within a gap defined between the insulator and the fitting in an interior of a distal part (on the igniting section side) of the fitting, first and second seal packings are arranged such that the second seal packing is positioned closer to the igniting section in comparison to the first seal packing. Furthermore, electrically insulating oil is filled in a section between the first and second seal packings within the gap.

A channel is provided through the second seal packing, which is positioned near the igniting section, to allow effluent of a small amount of the insulating oil through the channel toward the igniting section of the plug. With this construction, the small amount of insulating oil flowing from the channel to the igniting section forms a coating on the surface of the insulator in the high temperature environment, for example, during high engine speed operations, so that the reduction of the insulation resistance is advantageously inhibited, and disappearing of the insulating oil within a short period of time upon exposure to. the high temperatures is also inhibited, resulting in a long lasting anti-fouling effect of the insulating oil.

However, in the spark plug disclosed in the described Unexamined Japanese Utility Model Publication, two seal packings are required. Since the second seal packing disposed near the distal end of the fitting (near the igniting section) has a relatively complicated structure including the channel, the entire plug structure is disadvantageously complicated. On the other hand, if the second seal packing disposed near the distal end of the fitting (near the igniting section) is not provided, the insulating oil will disappear within a short period of time upon exposure to the high temperatures, and therefore the anti-fouling effect of the insulating oil will not last for a relatively long period of time.

SUMMARY OF THE INVENTION

The present invention addresses the described problems, and it is an objective of the present invention to provide a spark plug with a relatively simple structure that can retain electrically insulating oil within a gap defined between an insulator and a fitting for inhibiting the fouling of the insulator and that can maintain the anti-fouling effect of the insulating oil for a relatively long period of time.

The present invention is based on the fact that silicone oil, fluorine oil, or the like used as the insulating oil is liquefied and has a surface tension under the operating conditions (for example, at 200–300 degrees Celsius), so that if the gap defined between the insulator and the fitting becomes narrow enough, the insulating oil can be retained within the gap by the surface tension of the insulating oil.

To achieve the objective of the invention, a spark plug comprises a central electrode, an insulator disposed outside of the central electrode, a fitting disposed outside of the insulator and a ground electrode electrically connected with the fitting and also facing the central electrode. An annular seal member is disposed in a gap defined between the insulator and the fitting. Electrically insulating oil is filled in an oil-retaining section of the gap that is located on the distal side of the seal member. The oil-retaining section of the gap extends axially and continuously for a length of 2 mm or more. The oil-retaining section has a profile that allows retention of the electrically insulating oil within the oil-retaining section of the gap by a surface tension of the electrically insulating oil while the electrically insulating oil is in a liquid state.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE INVENTION

Figure 1:
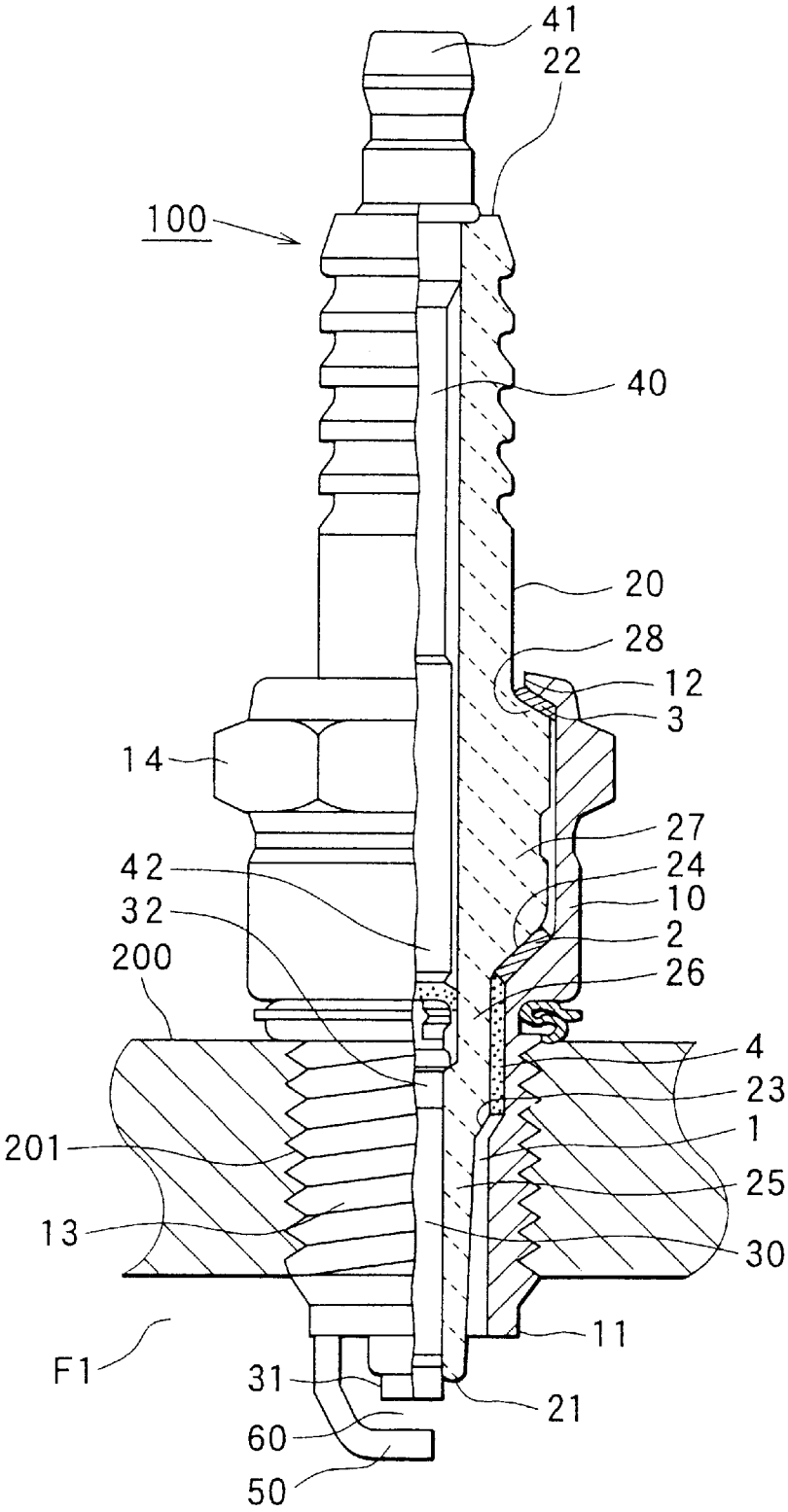
FIG. 1 is a half cross-sectional view of a spark plug in accordance with an embodiment of the present invention, showing an entire construction of the spark plug.

One embodiment of the present invention will now be described with reference to the accompanying drawings. As shown in FIG. 1, the spark plug 100 is threadably inserted and secured in a threaded hole 201 formed in an engine head 200 that defines part of a combustion chamber F1 of an engine.

A generally cylindrical fitting (main fitting) 10 is made, for example, of conductive steel material (such as low carbon steel). At a distal end (on the combustion chamber side) 11 of the fitting 10, a threaded section 13 is formed about a longitudinal axis of the fitting 10 on the outer peripheral surface of the fitting 10. The threaded section 13 is provided for threadably engaging with the corresponding threaded hole 201 when the plug 100 is threadably inserted into the threaded hole 201 by rotating a hexagon head 14 provided on the fitting 10 with aid of a tool, such as a wrench or the like. With this thread engagement, the plug is secured to the threaded hole 201.

A cylindrical insulator 20 made, for example, of alumina ceramics ($Al_2O_3$) is held inside the fitting 10, and a distal end 21 and a proximal end 22 of the insulator 20 are exposed from the distal end 11 and a proximal end 12 of the fitting 10, respectively. On the outer periphery of the insulator 20, two annular steps, i.e., first and second steps 23, 24 are provided. An outer diameter of the insulator 20 increases from the distal end 21 toward the proximal end 22 to form a small diameter section 25, a medium diameter section 26 and a large diameter section 27 while the first and second steps 23, 24 constitute boundaries for these sections 25–27. The second step 24 is located closer to the proximal end 22 of the insulator 20 in comparison to the first step 23 and constitutes the boundary between the medium diameter section 26 and the large diameter section 27.

On the second step 24, there is an annular seal packing (which is referred as-a seal member in the present invention) 2 extending circumferentially along the second step 24. The seal packing 2 is made of iron metal and provides a seal between the insulator 20 and the fitting 10. At a step 28 formed on the large diameter section 27 on the proximal end 22 side of the insulator 20, the proximal end 12 of the fitting 10 is caulked via an annular metal packing 3.

Electrically insulating oil 4, such as silicone oil or fluorine oil, which is in a gel state under room temperature and is in a liquid state under operating conditions of the plug (for example, under the temperature ranging from 200 to 300 degrees Celsius), fills an oil-retaining section of a gap 1, which is defined between the insulator 20 and the fitting 10 and is located on the distal side of the seal packing (seal member) 2. In this particular instance, the oil-retaining section of the gap 1 is the gap defined between the medium diameter section 26 of the insulator 20 and the fitting 10.

Figure 2:
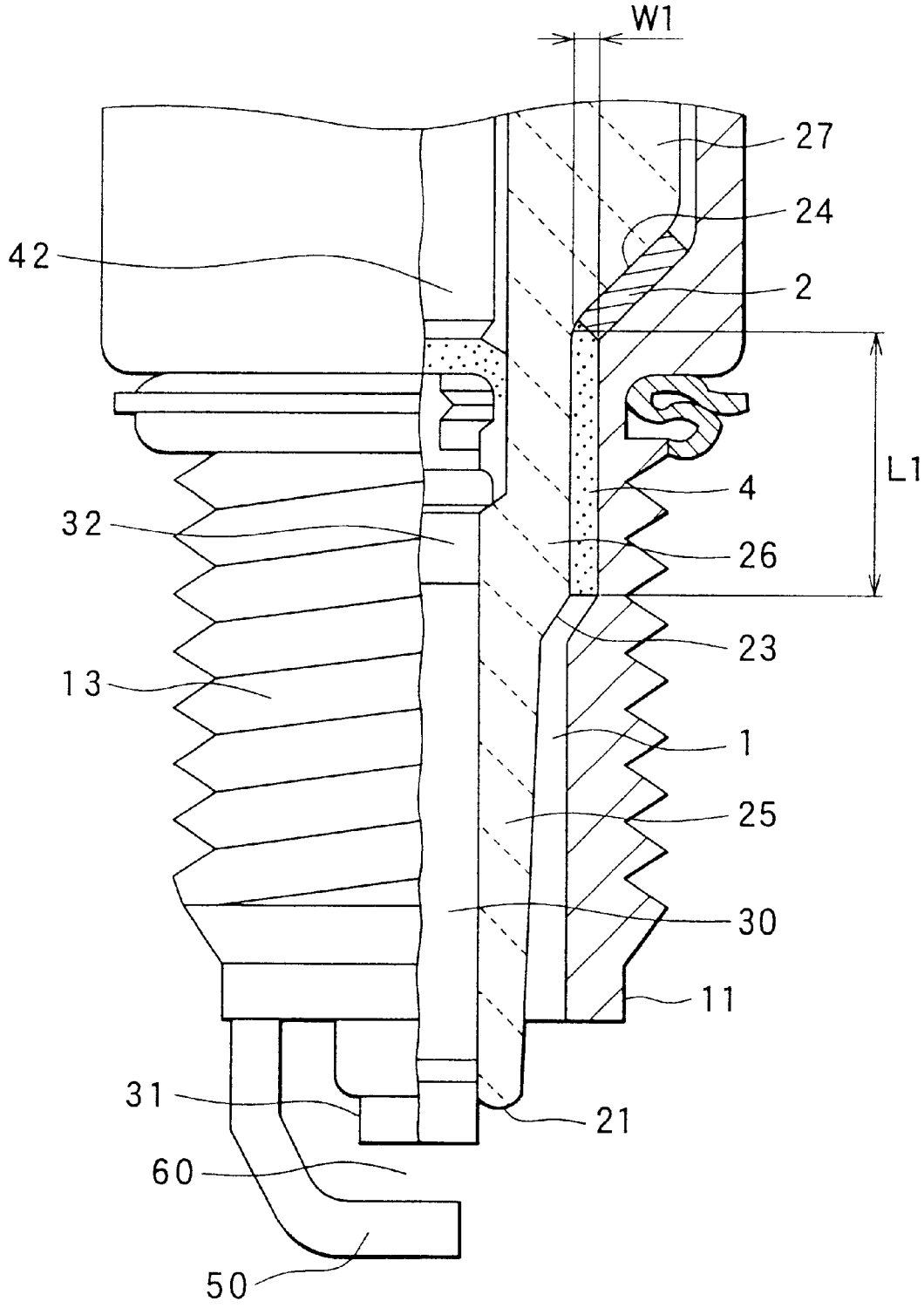
FIG. 2 is an enlarged view of an igniting section side of the spark plug shown in FIG. 1.

The oil-retaining section of the gap 1 is the continuous section having a width W1 (FIG. 2) ranging from 0.05 mm to 0.3 mm and an axial length L1 (FIG. 2) of 2 mm or more from the seal packing 2. With this construction, the filled insulating oil 4 can be retained within the gap 1 by the surface tension of the insulating oil 4 under the operating conditions (in the liquid state). That is, the oil-retaining section of the gap 1 has a profile that allows the retention of the insulating oil by the retaining force resulting from the shape property and the viscosity of the liquid insulating oil 4.

Specifically, the insulating oil 4 can be one that has silicone as a main component or that has silicone and wax additive. By way of example, the insulating oil can be filled as follows. About 10 to 20 mg of the silicone oil, which is used as the insulating oil 4 in this embodiment, is first added into solvent. This solution is injected into the gap 1 through an opening (on the distal end 11 side of the fitting 10) of the gap 1, and then the solvent is evaporated.

A cylindrical central electrode 30 and a stem 40 are secured within the insulator 20. A distal end 31 of the central electrode 30 is exposed from the distal end 21 of the insulator 20, and a proximal end 41 of the stem 40 is exposed from the proximal end 22 of the insulator 20. A proximal end 32 of the central electrode 30 and a distal end 42 of the stem 40 are electrically connected with each other within the insulator 20. With the above described construction, the central electrode 30 is electrically insulated and is held within the fitting 10 while the distal end 31 of the central electrode 30 is exposed from the distal end of the fitting 10.

A ground electrode 50 is secured to the distal end 11 of the fitting 10, for example, by welding at its proximal end. The ground electrode 50 is bent into a generally L-shape, and a distal free end of the ground electrode 50 faces the distal end 31 of the central electrode 30 across a discharging gap 60. As shown in FIG. 1, the discharging gap 60 of the spark plug 100 is disposed within the combustion chamber F1, and a spark discharge is created at the discharging gap 60 by applying a high discharge voltage between the fitting 10 and the central electrode 30 to combust a fuel-air mixture within the combustion chamber F1.

In the described embodiment, the insulating oil 4 is retained within the oil-retaining section of the gap 1 by its surface tension. As the operating temperature of the plug rises, the surface tension is reduced, causing a small amount of the insulating oil 4 to flow from the oil-retaining section of the gap 1 toward the small diameter section 25 of the insulator 20 to create a coating of the insulating oil 4 on the surface of the small diameter section 25. With this coating, the small diameter section 25 of the insulator adjacent to the igniting section can be effectively protected from the fouling resulting from adhesion of the conductive materials, such as carbons or the like.

The reasons for setting the width W1 of the oil-retaining section to be in a range of 0.05 mm to 0.3 mm are as follows. If the width W1 is less than 0.05 mm, it is substantially impossible to fill the insulating oil into the oil-retaining section, and if the width W1 exceeds 0.3 mm, the insulating oil cannot be retained within the oil-retaining section by the surface tension. The width W1 is more preferably in a range of 0.10 mm to 0.20 mm.

Furthermore, the reasons for setting the axial length L1 of the oil-retaining section of the gap 1 to be 2 mm or more are as follows. If the length L1 is 2 mm or more, the oil-retaining section is long enough to retain a practically enough amount of the insulating oil 4 therein. On the other hand, if the length L1 is less than 2 mm, a practically enough amount of the insulating oil 4 cannot be provided. This is based on an experimental study of the length L1 of the gap 1 having the width W1 that allows retention of the insulating oil 4 by the surface tension.

To illustrate this more specifically, a test (soot fouling test of a brand-new automobile) that is conducted to measure the anti-fouling effect before a brand-new automobile is passed to an automobile user from an automobile manufacture will now be described. During this test, the automobile having the spark plugs is disposed under −10 degrees Celsius environment. The lifetime of each plug is measured by counting the number of cycles until the misfire (soot fouling) is observed. Here, one cycle (for example, 2 minutes) includes steps of starting an engine and repeating quick acceleration and quick stop several times (for example, five times).

The described test shows that when the length L1 of the gap 1 is less than 2 mm, the measured lifetime of the spark plug is only about 5 to 8 cycles, and when the length L1 of the gap 1 is 2 mm or more, the measured lifetime of the spark plug is improved to about 10 to 15 cycles or more. For a typical brand-new automobile transportation pattern, a preferred lifetime is 10 cycles or more, so that the length L1 is set to 2 mm or more in this embodiment. As a result, the present embodiment is effective for preventing engine troubles, such as engine start-up problems, acceleration problems or the like, that are caused by the soot fouling of the plug during the brand-new automobile transportation.

Preferably, the axial length L1 of the oil-retaining section of the gap 1 is in a range of 2 mm to 10 mm. If the length L1 exceeds 10 mm, a size of the spark plug becomes larger and therefore becomes undesirable for a practical use. More preferably, the length L1 of the oil-retaining section ranges from 3 mm to 5 mm.

As described above, in accordance with the described embodiment, unlike the prior art, it is possible to provide a spark plug 100 with a relatively simple structure that can retain the insulating oil 4 within the gap 1 defined between the insulator 20 and the fitting 10 and that can maintain the anti-fouling effect of the insulating oil 4 for a relatively long period of time without necessitating another packing (the second seal packing) that prevents the effluent of an excess amount of the insulating oil from the gap.

With reference to the construction of the gap 1, if an enough amount of insulating oil 4 can be provided and can be retained by the surface tension of the insulating oil 4, the insulator 20 may have a generally constant outer diameter along its length without providing the large diameter section, the medium diameter section, and the small diameter section on it. Furthermore, the medium diameter section 26 of the insulator 20 is not necessarily parallel with the corresponding medium diameter section of the fitting 10 and may include non-straight shapes (such as a tapered shape, a bell shape, a wavy shape or the like).

Additional advantages and modifications will readily occur to those skilled in the art. The invention in its broader terms is therefore, not limited to the specific details, representative apparatus, and illustrative examples shown and described.

What is claimed is:

1. A spark plug comprising:

a central electrode;

an insulator disposed outside of said central electrode;

a fitting disposed outside of said insulator, wherein said fitting and said insulator define a gap between them;

a ground electrode having a proximal end electrically connected with a distal end of said fitting and also having a distal end arranged to face said central electrode;

an annular seal member disposed in said gap; and electrically insulating oil filled in an oil-retaining section of said gap that is located on the distal side of said seal member, wherein said oil-retaining section of said gap extends axially and continuously for a length of at least 2 mm and has a profile that allows retention of said electrically insulating oil within said oil-retaining section of said gap by a surface tension of said electrically insulating oil while said electrically insulating oil is in a liquid state.

2. A spark plug according to claim 1, wherein said oil-retaining section of said gap extends for a length of less than 10 mm.

3. A spark plug according to claim 1, wherein said oil-retaining section of said gap extends for a length ranging from 3 mm to 5 mm.

4. A spark plug according to claim 1, wherein said oil-retaining section of said gap has a width ranging from 0.05 mm to 0.3 mm.

5. A spark plug according to claim 1, wherein said oil-retaining section of said gap has a width ranging from 0.10 mm to 0.20 mm.

6. A spark plug according to claim 1, wherein said insulator has an outer diameter that increases from a distal end of said insulator toward a proximal end of said insulator so as to form a small diameter section, a medium diameter section and a large diameter section that are separated by respective steps, wherein said seal member is arranged at one of said steps that forms a boundary for said medium diameter section and said large diameter section, and wherein said oil-retaining section of said gap is defined between said medium diameter section and said fitting.

7. A spark plug according to claim 1, wherein said electrically insulating oil includes silicone as a main component or alternatively includes silicone and wax additive.

8. A spark plug according to claim 1, wherein said oil retaining section of said gap has an annular opening on its distal end side, wherein said annular opening extends continuously along the entire circumference of said insulator.

9. A spark plug according to claim 1, wherein said insulating oil is in contact with said seal member and with gas in said gap annularly at a side opposite the seal member.

* * * * *